US008888616B2

(12) United States Patent
Kitchen

(10) Patent No.: US 8,888,616 B2
(45) Date of Patent: Nov. 18, 2014

(54) METHOD AND DEVICE FOR CONTROLLING ELONGATION OF RACQUET STRINGS

(71) Applicant: Stringadvantage Tennis, LLC, Charleston, SC (US)

(72) Inventor: Michael S. Kitchen, Charleston, SC (US)

( * ) Notice: Subject to any disclaimer, the term of this patent is extended or adjusted under 35 U.S.C. 154(b) by 74 days.

(21) Appl. No.: 13/780,830

(22) Filed: Feb. 28, 2013

(65) Prior Publication Data

US 2013/0225337 A1 Aug. 29, 2013

Related U.S. Application Data

(60) Provisional application No. 61/604,689, filed on Feb. 29, 2012.

(51) Int. Cl.

| | |
|---|---|
| ***A63B 51/00*** | (2006.01) |
| ***A63B 59/00*** | (2006.01) |
| ***A63B 49/00*** | (2006.01) |
| *A63B 49/02* | (2006.01) |
| *A63B 49/06* | (2006.01) |

(52) U.S. Cl.

CPC ..... *A63B 49/002* (2013.01); *A63B 49/0288* (2013.01); *A63B 59/0074* (2013.01); *A63B 49/06* (2013.01); *A63B 59/0088* (2013.01); *A63B 49/007* (2013.01)

USPC ..... 473/540

(58) Field of Classification Search

None

See application file for complete search history.

(56) References Cited

U.S. PATENT DOCUMENTS

| | | | | | |
|---|---|---|---|---|---|
| 4,326,713 | A | * | 4/1982 | Balaban | 473/556 |
| 4,593,905 | A | * | 6/1986 | Abel | 473/534 |
| 4,976,433 | A | * | 12/1990 | Pohlenz et al. | 473/534 |
| 5,257,780 | A | * | 11/1993 | Cook et al. | 273/371 |
| 5,257,781 | A | * | 11/1993 | Sines et al. | 473/539 |
| 5,299,462 | A | * | 4/1994 | Key | 73/862.391 |
| 5,454,525 | A | * | 10/1995 | Schamesberger | 242/147 R |
| 5,536,005 | A | * | 7/1996 | Koff | 473/543 |
| 5,570,883 | A | * | 11/1996 | Csabai | 473/543 |
| 5,720,680 | A | * | 2/1998 | Mark | 473/534 |
| 5,797,814 | A | * | 8/1998 | Janes et al. | 473/551 |
| 5,820,500 | A | * | 10/1998 | Raos | 473/557 |
| 6,336,877 | B1 | | 1/2002 | Arroyo et al. | |
| 6,764,417 | B1 | * | 7/2004 | Filippini | 473/548 |
| 6,811,502 | B1 | | 11/2004 | Janes et al. | |
| 6,919,130 | B2 | * | 7/2005 | Tokarsky et al. | 428/357 |
| 6,935,974 | B2 | * | 8/2005 | Filippini | 473/543 |

FOREIGN PATENT DOCUMENTS

| | | |
|---|---|---|
| JP | 08-107951 | 4/1996 |
| JP | 2010-104540 | 5/2010 |
| JP | 2011-010746 | 1/2011 |

OTHER PUBLICATIONS

International Search Report and Written Opinion from the Korean Intellectual Property Office dated Jun. 18, 2013.

* cited by examiner

*Primary Examiner* — Kurt Fernstrom
*Assistant Examiner* — Dolores Collins
(74) *Attorney, Agent, or Firm* — B. Craig Killough; Barnwell Whaley Patterson Helms

(57) ABSTRACT

A variably compressible device placed on the peripheral portion of a racquet frame over or through which a loop of racquet string is placed compressing and holding the device against the outside surface of the racquet frame. The device and method provides for a controlled degree of compressibility permitting selected strings to undergo greater deflection through processes of device compression and intrinsic string elongation when striking the ball compared to the behavior of an equivalent string striking the ball without the device.

16 Claims, 9 Drawing Sheets

METHOD AND DEVICE FOR CONTROLLING ELONGATION OF RACQUET STRINGS

Applicant claims the benefit of U.S. Provisional Application Ser. No. 61/604,689 filed Feb. 29, 2012.

FIELD OF THE INVENTION

This invention relates to sporting goods generally and is more specifically related to a device and method useful in sports that require strung racquets.

BACKGROUND OF THE INVENTION

Current tennis racquet designs provide a frame through which strings are threaded and placed under controlled tension. Modern racquet design typically provides "cleats" and "grommets" at the periphery of the racquet frame through which strings are threaded. These cleats and grommets are integral to the design of the specific racquet and are set at the time of manufacture. These cleats and grommets are fixed at the time of manufacture and are specific to particular racquet designs. Current designs do not permit variable selection of string pairs wherein increased elastic deformation can occur.

Typical string patterns provide for strings placed in one of two orientations relative to the long axis of the racquet; those oriented parallel to the long axis are referred to as "main strings" and those oriented perpendicular to the long axis are referred to as "cross strings". The elliptical geometry of the tennis racquet frame of necessity produces differing characteristics of deformability or relative elongation capacity as strings are positioned farther from the center of the racquet; i.e. those strings that are more distant from the center of the racquet deflect to a lesser degree than those pairs of strings placed close to the center of the racquet given equivalent string tension and force of impact.

Racquet makers have attempted to address force distribution across multiple string segments in various ways. By allowing for reduced friction as the string passes through the frame, tension can be distributed across multiple string segments; current manufacturers produce a variety of mechanisms designed to achieve less friction at the critical points where string loops cross through the frame. Current mechanisms include: large holes through the frame with smooth surfaces, specialized materials comprising the through frame grommets providing a lubricious surface and multi-grommet frame inserts of elastic material that provide a compressible insert where string loops go through the frame. Current techniques for addressing these issues are manufactured at the time of racquet production and as such are "fixed" systems not providing for customization of elastic properties of string pairs at or after stringing is performed. Furthermore these designs impart a specific mechanical profile to specific designs. These systems do not permit the individual player an opportunity to tune his racquet to specific play characteristics or needs. Furthermore, as these designs are formulated to perform optimally at specific string tensions they do not address differing physical characteristics arising when a player specifies string tensions that are different from those for which the racquet system was optimally designed.

SUMMARY OF THE INVENTION

A string guide member comprising an interchangeable elastic component is constructed for placement on a racquet frame. The interchangeable elastic component may be an insert that deforms when increased local tensile force is applied to the insert as a result of the force on the associated string pair when striking the ball. The insert facilitates elongation of, and provides a dampening effect to, the impacted local string pair. Elastic inserts may be interchangeable in the guide member for controlling elasticity and elongation for string pairs in response to ball impact. Multiple string guide members with elastic inserts may be selectively positioned around the perimeter of the racquet frame in a manner specific to an individual player's needs, with greater string elongation for those strings (string pairs) that comprise loop(s) passing over the elastic insert upon increased tensile force occurring when the ball is struck.

DESCRIPTION OF THE PREFERRED EMBODIMENTS

Figure 1:
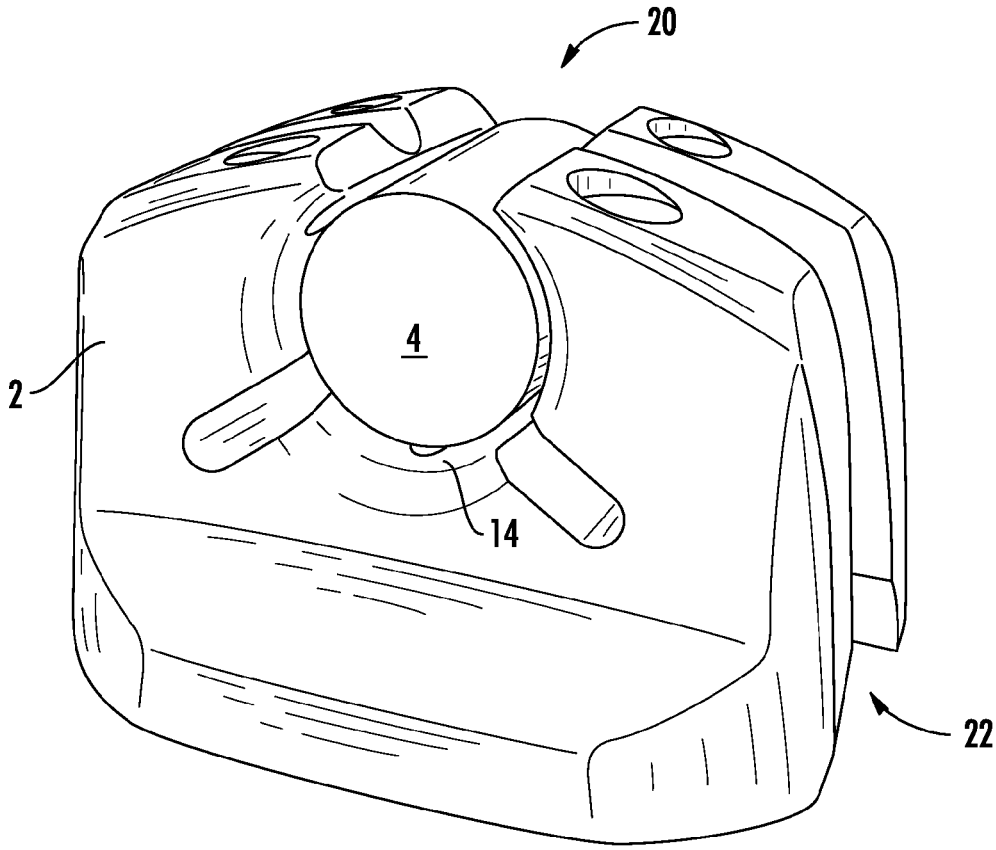
FIG. 1 is a perspective view of an embodiment of the device.

According to the embodiments of the device shown in the drawings, there are two primary components of the invention. A string guide member 2 comprises a compressible elastic component 4 therein. The compressible elastic component is preferred to be manually removable from the string guide member for replacement with a compressible elastic component having different properties, or in other words, the elastic component is preferred to be interchangeable.

Figure 2A:
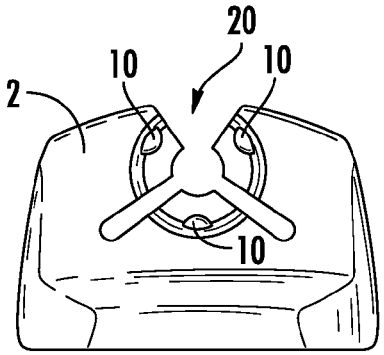
FIGS. 2A and 2B are elevations demonstrating the string guide member of FIG. 1, and the string guide member assembled with the interchangeable elastic component.
Figure 13:
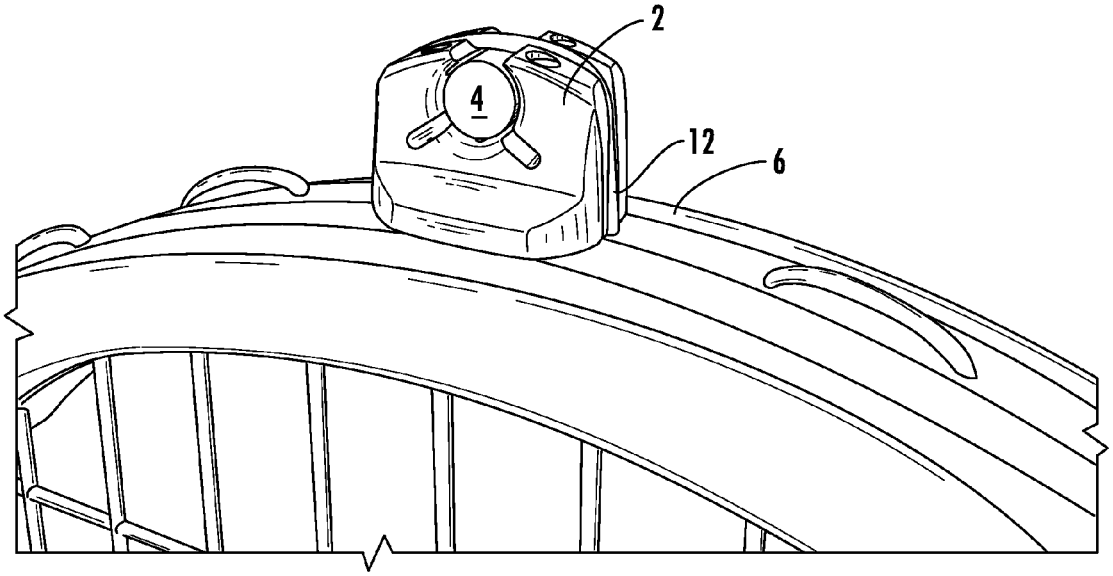
FIG. 13 shows an embodiment of the device mounted on a racquet frame.

In a preferred embodiment, the interchangeable elastic component 4 is contained within the string guide member 2 so as to form a compressible insert system for a strung racquet according to the invention. FIG. 1; FIG. 13. The string guide member is preferred to have a void, cavity or chamber that is sized to receive the interchangeable elastic component. FIGS. 2, 3. The void, cavity or chamber is referred to as the "chamber".

Figure 3A:
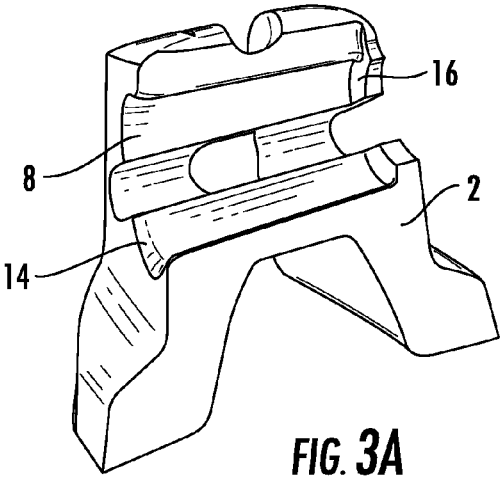
FIGS. 3A and 3B are sectioned views of the device of FIGS. 2A and 2B, respectively.
Figure 3B:
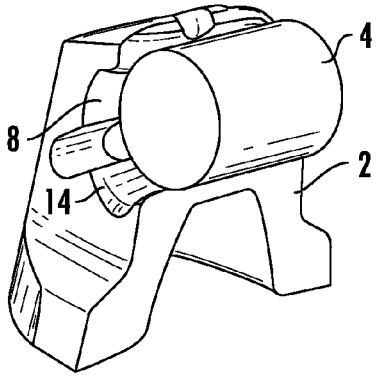
Figure 4A:
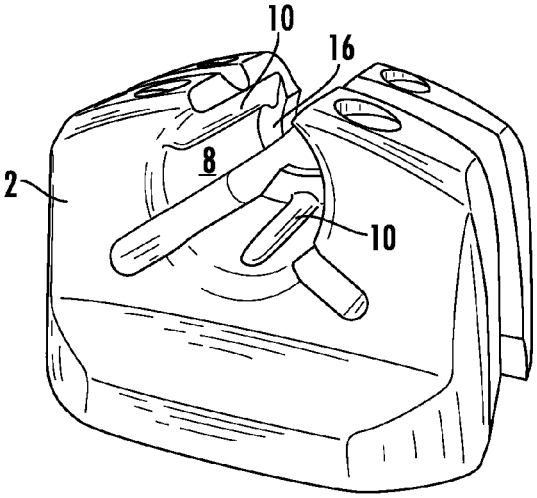
FIGS. 4A and 4B show embodiments of the device emphasizing chambers of the string guide member.
Figure 4B:
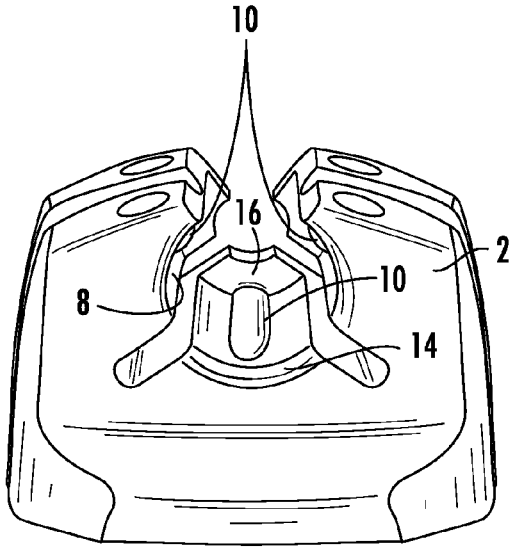

In this embodiment, the walls of the chamber 8 formed within the string guide member comprise "ribs" or "ridges" formed therein. FIG. 3. The ribs 10 or ridges contact the outer surface of the interchangeable elastic component. For example, three ribs protrude into the space defined as the chamber of the string guide member. FIG. 2; FIG. 4. The ribs of this embodiment contact the round outer contour of the interchangeable elastic component at the three linear contact areas, which may be distributed at 120 degree intervals about the circular peripheral wall of the chamber so as to be generally equidistant from each other. The ribs may have a rounded or accurate cross-section, and may be generally straight (FIG. 4B) or have an arcuate form (FIG. 4A) as they transverse some or all of the length of the chamber.

Placing the interchangeable elastic component into the chamber formed within the body of the string guide member as shown in FIGS. 1-3 causes elastic deformation to occur at the three areas of contact between the ribs and the interchangeable elastic component. In a preferred embodiment, the interchangeable elastic component is more elastically deformable than the material comprising the ribs of the chamber. Elastic deformation deferentially occurs on the interchangeable elastic component. The specific geometry of the ribs, or other element providing contact between the interchangeable elastic component and the chamber(s) of a string guide member, influences force/elastic deformation relationships at ball impact. There is a relationship between the geometric shape of the ribs and deformation of the interchangeable elastic component in response to the application of a given force at ball impact.

The string guide member is preferred to be an elastic member comprised of relatively durable material over which a loop of the racquet string 12 passes. The string guide member may be placed at any point on the periphery of the racquet 6 through which the strings pass as required for holding the string guide member in position. The string guide member is positioned at the time of stringing of the racquet. The string guide member is preferred to have the interchangeable elastic component in position in the chamber racquet at the time of stringing. This device affords a high degree of "tuneability" for a racquet. The technician stringing the racquet and the user of the racquet may selectively change the elastic response of individual string pairs of the racquet according to the characteristics of the racquet desired by the user.

The device may be positioned as desired around the circumference of the racquet. However, the orientation of the device and elements of the device as described herein refers to the orientation shown in the drawings, even though the device may be inverted and/or rotated during installation and use. For example, the terms "top" or "upper" refer to the top or upper portion of an element of the device as shown in the drawings, and not necessarily the orientation during use.

In use, increased tension on the strings created by impact with a ball is transmitted through the string pair to the device, resulting in a compressive force transferred from the string guide member to the interchangeable elastic component. The string guide member permits shortening of the string loop due to force on the associated strings at ball impact. The string guide member changes shape due to the force applied by the associated strings. The elastic properties of both the string guide member and the interchangeable elastic component contribute to resistance to deformation at ball impact, and both contribute to elastic recovery of shape subsequent to ball impact.

The chamber is preferred to allow ease of placement of the interchangeable elastic component at the time of stringing. The chamber may be sized to permit placement prior to tensioning of the racquet strings. Upon tensioning, the string guide member is likely to undergo slight deformation that places the interchangeable elastic member under a compressive force, like a clamping force.

The chamber of the string guide member need not necessarily conform exactly to the geometry of the interchangeable elastic component. In a preferred embodiment, the internal contour of the chamber has an irregular contour, wherein limited portions of the inner surface are in direct contact with the interchangeable elastic component under normal stringing tensions.

The chamber 8 that accepts the interchangeable elastic component may have an internal contour that differs from the contour of the interchangeable elastic component. The chamber may have an enlarged opening 14 to facilitate insertion of the interchangeable elastic component. The chamber may have a tapered shape, narrowing from the opening toward the opposite end, which may comprise a stop 16. FIGS. 3A, 3B. The chamber architecture may facilitate ease of insertion for the elastic component, and also modify elastic properties of the device as a whole.

Voids or gaps in the string guide member, such as structural relief slots or grooves, may be formed in the string guide member. The gaps form structural attenuation areas that attenuate the resistance of the string guide to deformation when subjected to forces of string impact. These areas of intentional structural attenuation permit the string guide member to undergo deformation, such as widening or narrowing the gaps, which may be slots, thereby transferring the force of impact to the interchangeable elastic component.

Figure 5A:
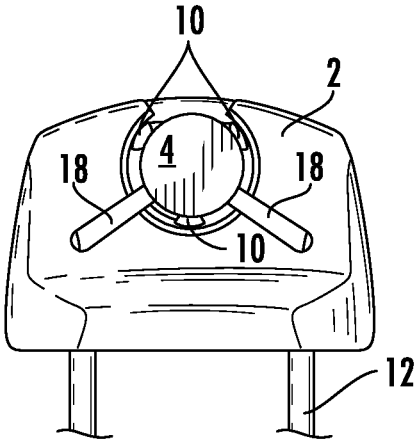
FIG. 5A is an elevation of the string guide member of FIG. 2 assembled with the interchangeable elastic component and with a racquet string contained in the string guide.
Figure 5B:
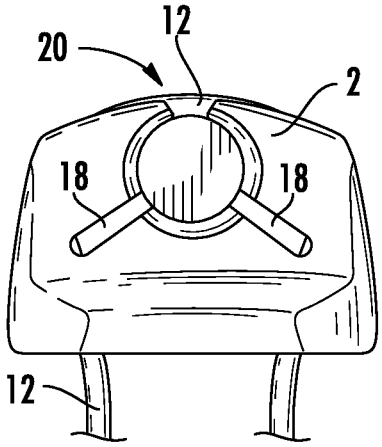
FIG. 5B is an elevation of the string guide member of FIG. 5A demonstrating the string guide member under compression from the racquet string.

Structural relief gaps or slots 18 may extend to the chamber 8 in which the interchangeable elastic component 4 is contained. The gaps or slots may be formed with the distance between lateral walls of the slot decreasing as the chamber in which the interchangeable elastic component is compressed. FIGS. 5A, 5B.

Figure 10A:
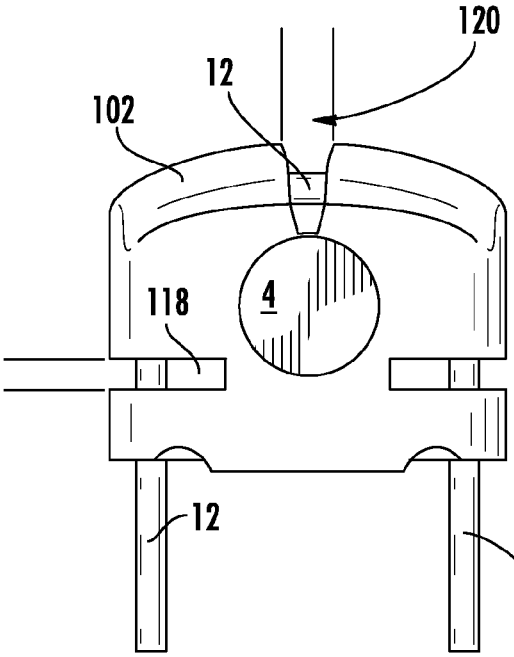
FIG. 10A is an elevation of the string guide member of FIG. 9A assembled with the interchangeable elastic component and with a racquet string contained in the string guide.
Figure 10B:
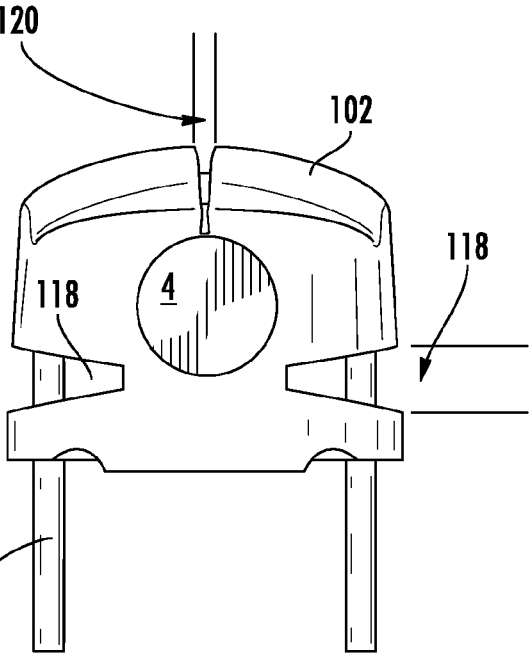
FIG. 10B is an elevation of the string guide member of FIG. 10A demonstrating the string guide member under compression from the racquet string.

In another embodiment, the gaps or slots 118 may extend partially through the body of the string guide member 102, without intersecting the chamber 108. This embodiment increases the distance between lateral walls of the slots 118 upon ball impact with the strings. FIG. 10A shows the device statically attached to a string 12, while FIG. 10B shows the device under dynamic tension as a ball contacts the string.

Figure 5C:
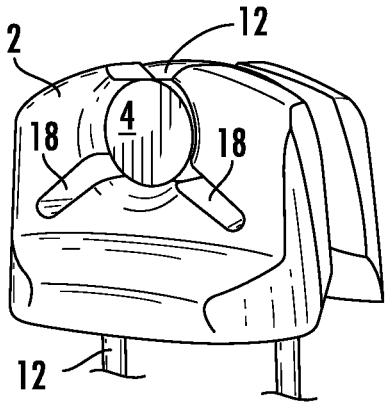
FIG. 5C is a perspective view of the string guide member of FIG. 5A.
Figure 5D:
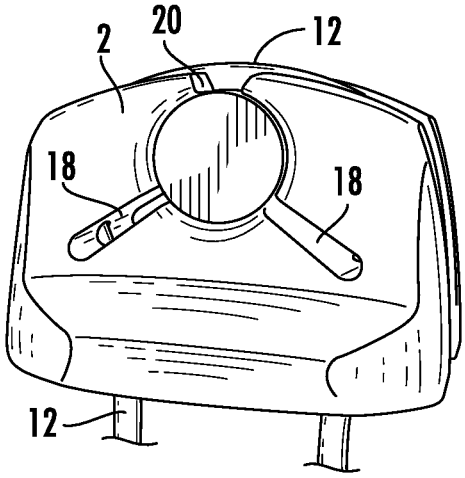
FIG. 5D is an enlarged perspective view of the string guide member of FIG. 5B.

FIG. 5A, FIG. 5C and FIG. 10A each show an embodiment of the device in a resting state, and the racquet string under normal tension and passing over the string guide member, with the interchangeable elastic component in position in the string guide member. FIG. 5B, FIG. 5D and FIG. 10B show the same configuration of the device, and the result of an impact of the strings with a ball, demonstrating typical dynamic changes in the string guide member occurring at structural relief voids or slots. A compressive force is also applied to the interchangeable elastic component. The upper or apical gap 20, 120, 220, 320, 420 dimension roughly determines the maximal elongation the string pair may undergo when subjected to the force of ball impact. The apical structural relief gap or slot narrows as string guide member 2, 102, 202, 302, 402 undergoes compressive deformation upon ball and string impact. The upper, apical gap may intersect the chamber above the interchangeable elastic component. This upper gap narrows in response to dynamic pressure applied to the string guide member by the dynamic load from ball impact on the string. The interchangeable elastic component prevents the upper gap from closing when the string guide member is under static load from the racquet string.

In one embodiment, the lateral structural relief gaps 18 or slots provide relief to tensile force within the lateral areas of the string guide member, which occurs as the sidewalls of the apical structural relief gap 20 move closer together. A dimension of the gaps 18, 118, 218, 318 or slots changes in response to dynamic pressure applied to the string guide member by the racquet string as it acts upon the string guide member to narrow the upper, apical gap of the string guide member. This relationship between compression and expansion type slots accommodates the need to minimize the structural contribution of the string guide member to the complete system. Any combination of gaps designed to compress (narrow) or (widen) expand when subjected to impact may be selected to meet the needs of a particular design.

As shown in the drawings, increased string tension from ball impact will either cause a slot or slots to narrow, bringing opposing lateral sides together (compression gaps 18, 20), or increased string tension will cause the slot to widen moving the lateral sides of the slot apart (expansion gaps 118, 120). These slot mechanisms may work in tandem in as much as movement of side walls together at compression slot(s) is accommodated by separation of side walls at an expansion slot(s).

Figure 11A:
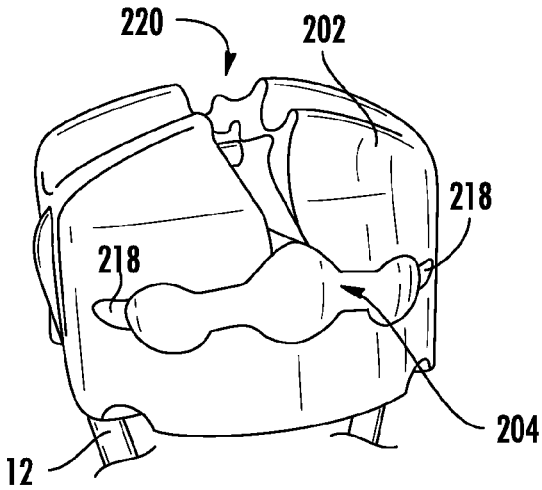
FIG. 11A demonstrates string guide member shown with an irregular geometry interchangeable elastic component in a dumbbell configuration.

Some designs may utilize a combination of compression slots to accommodate motion of the string guide member without the use of expansion slots. FIGS. 11A;11B. The design may utilize an apical compression gap 220, 320 or slot, with opposing side walls that limit the elongation distance and internal compression of slots that extend to the chamber containing the interchangeable elastic component, and which do not extend through the lateral walls of the string guide member.

In an embodiment, a gap, slot or groove formed at the apex of the string guide member provides a "stop" against further deformation. When string tension increases due to ball impact, the sides of the apical structural relief slot meet, precluding further deformation of the string guide member. Resistance to deformation before this limit is reached is determined by the physical characteristics of the interchangeable elastic component (and particularly resistance to compression), plus the characteristics of the string guide member. The width of this slot or distance across this gap directly correlates with the maximum elongation for each string pair. This gap will typically be 2 mm to 4 mm in width, and string pair elongation due to elastic properties and resistance to compression of the insert will typically be limited to 2 mm to 4 mm. Elongation of strings at impact due to intrinsic elastic properties of string materials will occur in a conventional manner, contributing to total elongation.

Differential physical characteristics may be provided for adjacent string pairs. The string pair utilizing the device has greater elastic capability than the immediately adjacent string pair that does not utilize the device according to the invention. This controlled differential in physical characteristics between string pairs produces alterations in the way that the ball interacts with the string bed at impact. The device is placed at selected positions on the periphery of the racquet frame to control elastic properties of selected string pairs, which results in a high degree of variability in the playing characteristics of the racquet that is dependent upon which pairs of strings are selected at the time of stringing.

The device is constructed to provide controlled and predictable degrees of compressibility. Variable resistance to compression may be achieved after installation of the device, which occurs during stringing of the racquet. The elastic components may be easily interchanged at the time of stringing to provide desired physical characteristics, thereby allowing a high degree of variability in selection of elastic characteristics. Individual needs and preferences may be met by altering the physical attributes of the device by selection of the interchangeable elastic component, thereby altering the play characteristics of a given racquet.

The interchangeable elastic component 4 is contained within the chamber 8 of the string guide member 2. This chamber is constructed to accommodate the shape or form of the interchangeable elastic component, and receives and holds the interchangeable elastic component. The walls of the chamber may contact the interchangeable elastic component in a discontinuous manner such that force of impact is transmitted to the interchangeable elastic component through specific points of contact that affect the elastic properties of the entire device. The walls of the chamber may be structured with a contour or profile that is irregular relative to the matching contour or profile of the interchangeable elastic component, or the contour or profile of the interchangeable elastic component may be irregular relative to the contour or profile of the chamber. Alternatively, the walls of the chamber and the outer contour or profile of the interchangeable elastic component may both provide discontinuous surface contact, such as by providing ribs 10 or other protrusions from the wall of the chamber that contact the interchangeable elastic component.

These design variables allow for targeted application of the device to produce desired physical responses at specific impact forces while producing a device having adequate "elastic potential" at specified string tensions. It is preferred that that elastic deformation occurs at forces that are just greater than the force applied to the device at string tensioning. Therefore, elastic deformation just begins to occur at string tensioning, while the greatest deformation occurs at ball impact wherein string pairs undergo tensioning beyond that set at stringing of the racquet.

For conventional string tensions ranging from 44 to 72 pounds, plastics with a Shore A durometer hardness of between 60 and 95 have proven capable of maintaining gap distances, while providing adequate remaining the elastic deformation capacity to perform as designed. The interchangeable elastic component may comprise significantly softer or harder materials to accommodate specialized needs of some players who string racquets with tensions well outside of conventional ranges.

The interchangeable elastic component compressibility directly correlates to the capacity of that component to maintain separation between side walls of a compression slot in the string guide member. At a given string tension (resting tension), compression occurs as string tension increases at ball impact to just above this resting tension. An interchangeable elastic insert with greater density or resistance to compression does not begin undergoing elastic compression until string tension is relatively much greater than the resting tension set at the stringing process. Conceptually, this feature provides a construct wherein the design can be specified such that meaningful elastic compression of the interchangeable elastic component occurs at a threshold of tension just above the specified resting tension set at the time of stringing. Interchangeable elastic components may have an upper limit string tension specification that maintains side wall gap at the compression slots, and above that compression, side wall gap at the compression slots starts to close. Further, an objective elastic yield tension (specified in lbs or kg), or a relative characteristic (soft, medium, hard) may be specified for interchangeable components to indicate to users when elastic deformation may be expected to occur during play.

By way of example, a device may have the following specifications: Elongation 3 mm, String tension 55 lbs, Elastic yield 65 lbs. Elongation indicates the maximum allowable elongation to an individual string pair; in this example, a compression slot gap of 3 mm is expected. String tension specifies that stringing the racquet at the indicated force (55 lbs) or less will maintain the 3 mm gap for the compression slot. Elastic yield indicates that meaningful compression of the interchangeable elastic component begins when string tension reaches 65 lbs at ball impact.

Figure 6:
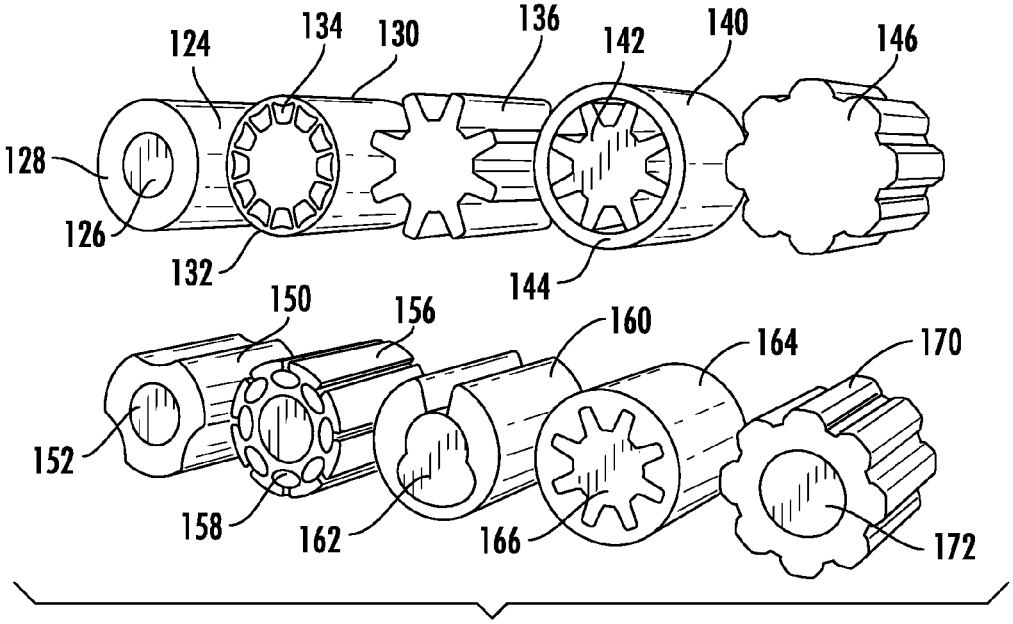
FIG. 6 shows elevations of multiple embodiments of the interchangeable elastic component.

FIG. 6 shows exemplary embodiments of interchangeable elastic components. Variable elastic properties may be achieved through material selection and resistance to compression, but also by differing the geometric configuration. The interchangeable elastic component may be formed of a single elastic material, which may be a polymer. The interchangeable elastic component may have a uniform consistency and have a repeatable elastic performance. The interchangeable elastic component is preferred to be durable, retaining its properties for consistent performance for several months of use. Examples of complex geometry and composite structure interchangeable elastic components are shown in FIG. 6.

Figure 2B:
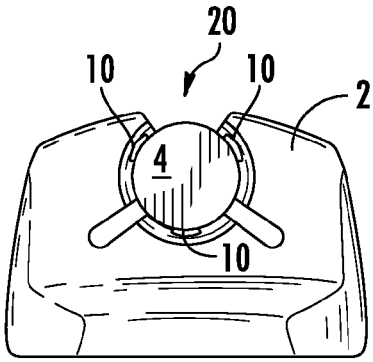

A solid cylindrical configuration 4 of the interchangeable elastic component formed in a single, uniform material may be employed, wherein the material properties of the component alone determine the elastic response to strain. FIG. 1; FIG. 2B. An embodiment 124 of the interchangeable elastic component formed in a solid cylindrical configuration may include a core of a first material surrounded by a second material, with each having different properties in resisting compressing forces from the string guide member.

A cylindrical geometry 130 with radially extending members 132 and peripherally distributed voids 134 is shown. This embodiment (and others) may be formed by extrusion. This configuration attenuates resistance to impact force for the initial portion of deformation. As compression reaches a limit, the voids collapse, and resistance to further compression increases in a non-linear manner, with relatively more resistance occurring in response to relatively smaller increases in force.

A cog shaped cross-section 136 is shown. In use, this embodiment acts essentially as a cylindrical geometry. Its peripherally attenuated structure is capable of producing a nonlinear elastic response to impact force.

A composite structure 140 having a cog shaped inner core 142 contained within a tubular sheath 144 is shown. The tubular sheath and cog shaped portion may be constructed of multiple materials, each having different physical characteristics.

A daisy shaped interchangeable elastic component of solid composition 146 which has compression properties that are similar cylindrical embodiment. The peripherally placed profile cutaways reduce the surface area of contact between the interchangeable elastic component and the chamber walls of the string guide member. This embodiment reduces the force required to manually place the interchangeable elastic component into the string guide member chamber, while preserving physical characteristics similar to a solid cylindrical configuration.

In another embodiment of the interchangeable elastic component about 40-60% of an outer surface 150 is absent as compared with a cylindrical device, thereby reducing contact area with the chamber. An elastic outer portion 150 is shown surrounding a more rigid central core 152. Friction is reduced for manual placement, the compressible resistance of the elastic outer portion is attenuated.

A plurality of lumens and/or cutaways 158 of the interchangeable elastic component is shown. Portions of the lumens or cutaways may be filled with elements having differing physical characteristics. These physical characteristics may be varied to produce devices having varied compressibility properties. The device 156 may filled with elastic elements and at the time of manufacture or at the time of stringing. Individual elastic elements may be selectively removed or replaced providing a scalable means of changing elastic properties of the device.

An embodiment of the interchangeable elastic component has an asymmetrical structure, with both an asymmetric outer component 160, and an asymmetric inner core 162. Deformation occurs to a greater degree at selected portions of the interchangeable elastic component. Elastic deformation at application of force occurs disproportionately through the interchangeable elastic component cross-section, allowing greater movement relative to force at portions.

A cog shaped inner element 166 is surrounded by a conforming element comprised of a second material 164 to form an interchangeable elastic component. This embodiment allows varied force/deformation relationships to occur, based upon the properties and relationship between the two materials comprising the interchangeable elastic component.

Another embodiment of the interchangeable elastic component comprises an outer area 170 with limited contact surface area, and a central core 172 of differing composition. This embodiment combines an attenuated surface contact area with the central core adding structural rigidity to the interchangeable elastic component. This embodiment requires less force to manually position into the chamber, and depending upon amount of material comprising the outer area, may have varied elastic properties.

Forming the interchangeable elastic component of softer materials may offer desirable qualities of elastic compressibility and recovery. However, if the entire interchangeable elastic component is comprised of these materials, the string guide member reaches maximum compression under normal string tension, thereby affording no further capacity to compress at impact. By constructing the interchangeable elastic component of two materials having differing elastic properties, a construct is achieved whereby softer elastic properties are exploited. An outer sheath comprising a smaller volume that maintains potential elastic deformation through a broad range of forces may be coupled with a hard inner core that prevents large volumetric compression through lower end force application. A soft outer tube with a hard solid core responds to force quite differently than a similarly sized uniform construct singularly comprised of soft material. The solid construct of soft material tends to compress greatly under lower end loads, allowing the string guide member to reach its compressive limit, whereas the construct composed with soft outer tube and hard inner core initially deforms with less with equivalent force, but continues to compress and resist the compressive force through a wider range of force application.

In one embodiment, an interchangeable elastic component comprises a relatively softer material forming the outer portion of the design. Contained within a central lumen of the tubular component is a relatively harder inner core sized to fit within the lumen. This embodiment prefers materials with greater compressibility for the outer portion of the interchangeable elastic component, with a relatively harder inner core. Normal string tensions do not fully compress the interchangeable elastic component, and there remains elastic potential that is activated upon ball impact upon the string bed. This embodiment is partially compressed at resting string tension, and compresses further at ball impact, and recovers upon ball release.

In another embodiment of the interchangeable elastic component a homogeneous material may be extruded with multiple lumens located circumferentially at the periphery. This interchangeable elastic component is comprised of relatively harder material, wherein the peripheral portion of the component is structurally attenuated through the omission of material, as compared to an equivalent solid extrusion. This embodiment provides a relatively less compressible central portion of the interchangeable elastic component, while the peripheral portion has disproportionate compressibility due to structural attenuation.

The interchangeable elastic component may have a cog shaped profile. This configuration produces a non-linear force/compression response, wherein the interchangeable elastic component is relatively easily compressed with initial force application, and becomes increasingly more resistant to compression as it undergoes greater elastic deformation.

This embodiment is a composite structure having a relatively rigid inner cog shaped profile positioned within an elastic tubular extrusion. As force is applied to the interchangeable elastic component, the relatively more elastic tubular outer portion undergoes differential elastic deformation. Greater forces cause the outer tubular structure to deform into the voids provided between the spokes of the cog. When the limit of elastic deformation is reached for the tubular element, further resistance to force becomes largely a function of the physical properties inherent to the more rigid inner cog component. This embodiment provides an elastic performance profile wherein relatively larger deformation per unit force occurs through initial compression, and a large step-up of resistance to deformation occurs when the elastic limit of the tubular portion is reached. Structural resistance of the more rigid inner cog component is enlisted to control deformation in response to greater force application.

The interchangeable elastic components 136, 146, 150, 160, 170 may be configured with a cross-sectional profile that provides for interrupted contact within the string guide member chamber. By providing less surface area at which the interchangeable elastic component contacts the surface of the string guide member chamber quantitatively alters the force/deformation response of the device. Surface area contact increases as force is applied through ball impact. There is a direct relationship between the increase in contact surface area and increased resistance to further elastic deformation.

A composite embodiment 170 may combine a relatively large outer extrusion with a relatively rigid core. The surface area of contact between the interchangeable elastic component and the string guide chamber is reduced. Attenuated force/deformation response and decreased fictional and compressive resistance to manual placement of the interchangeable elastic component is achieved. The more rigid core component provides a relatively less compressible element to the structure that is exhibited when the more elastic outer element reaches limits of elastic deformation.

An interchangeable elastic component of complex geometry 156 may have material properties that vary for different components. The relative compressibility of different components permits production of multi-stepped force/deformation properties. As compression of this embodiment occurs, the peripheral elements contained within the multiple lumens are compressed, and as these outer elements reach limits of elastic deformation, the central core contributes to resisting further application of force.

One embodiment has an asymmetrical design, with both an asymmetric outer component, and an asymmetric inner core. Deformation occurs to a greater degree at selected portions of the interchangeable elastic component.

Another embodiment may comprise multiple differing materials. A cog shaped inner element 166 is surrounded with a conforming element comprised of a second material 164. This embodiment also allows for varied force/deformation relationships to occur based upon the properties and relationship between the two materials comprising the interchangeable elastic component.

Another embodiment may comprise an outer profile with limited contact surface area 170 and a central core of differing composition 166. This embodiment combines an attenuated surface contact area with a central core element that adds structural rigidity to the construct.

The interchangeable elastic component may be constructed to allow variable compressibility after installation in the chamber of the string guide member. The variably compressible device may be formed of a compressible material that, when compressed about its ends, provides additional compression resistance under dynamic force from the string guide member as a ball strikes the associated racket strings.

Figure 7A:
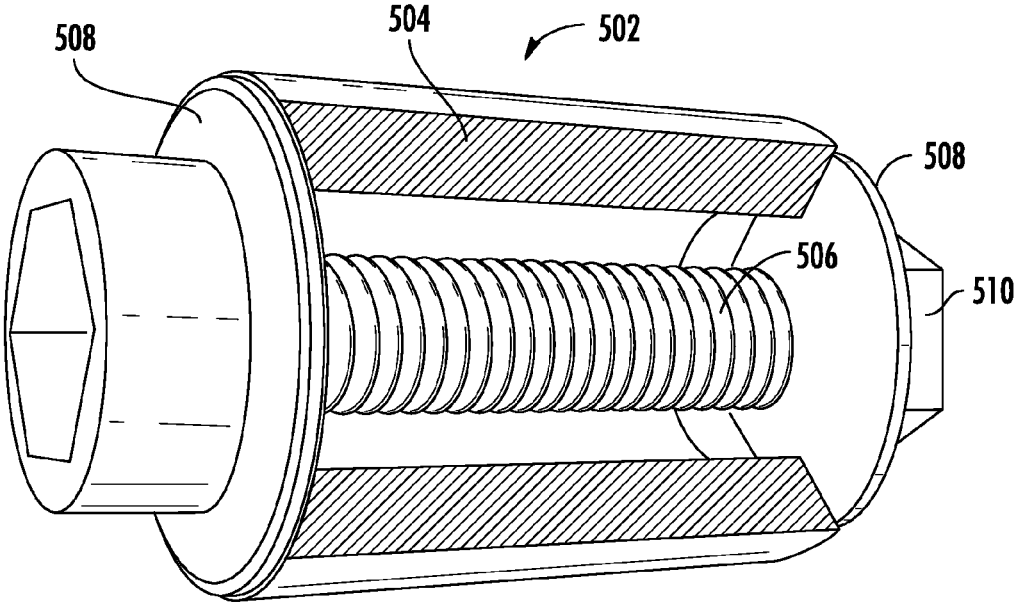
FIG. 7A is an enlarged sectioned view of an adjustable interchangeable elastic component having variable elastic properties.
Figure 7B:
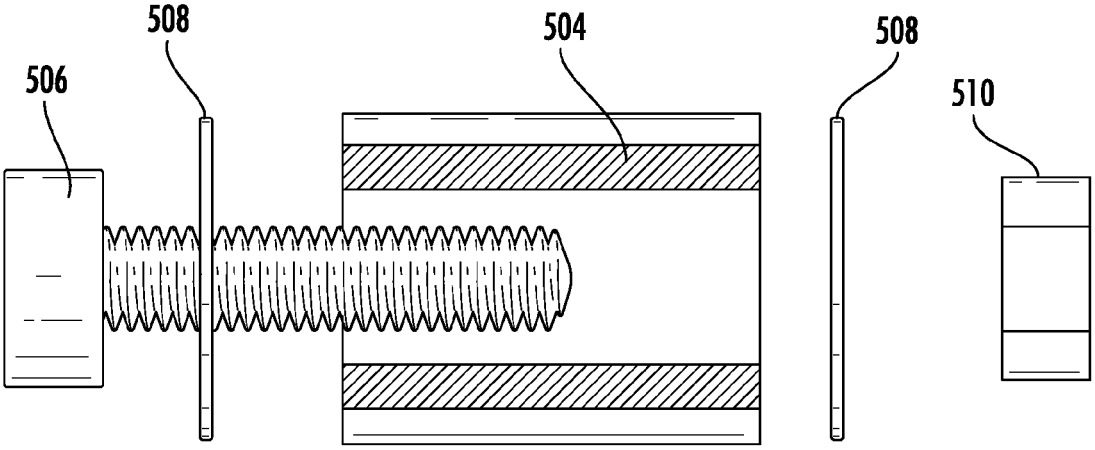
FIG. 7B is an exploded view of the adjustable interchangeable elastic component of FIG. 7A.

In one embodiment, the variable compressible interchangeable elastic component has a threaded member 506 with a pressure plate 508 on each end of the elastic component 504. The threaded member is used to apply additional pressure, or to reduce pressure, on the elastic component by moving the pressure plates toward each other to increase pressure, and away from each other to reduce pressure. As pressure is increased, the device will have more resistance to compression applied by the string guide member, and as pressure is decreased, the interchangeable elastic component will have less resistance to compression force, and affect the playing properties of the racket accordingly. As shown in FIG. 7A and FIG. 7B, the device comprises a threaded member, which may be a threaded member such as a cap screw that passes through a central aperture or lumen of the elastic component and threads onto a nut 510. The pressure plate is present on each side of the elastic component.

Figure 8A:
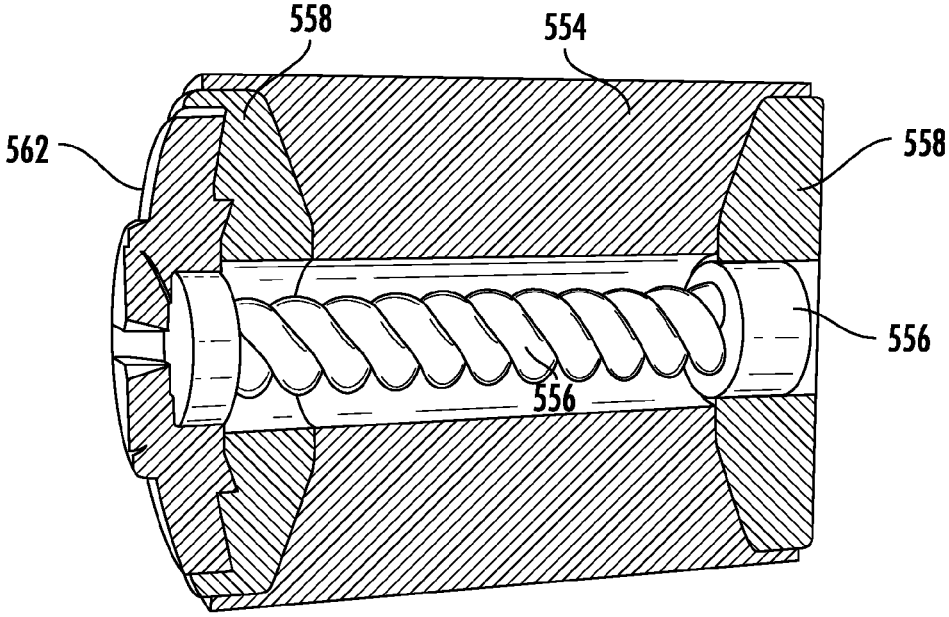
FIG. 8A is an enlarged sectioned view of another embodiment of an interchangeable elastic component having variable elastic properties.
Figure 8B:
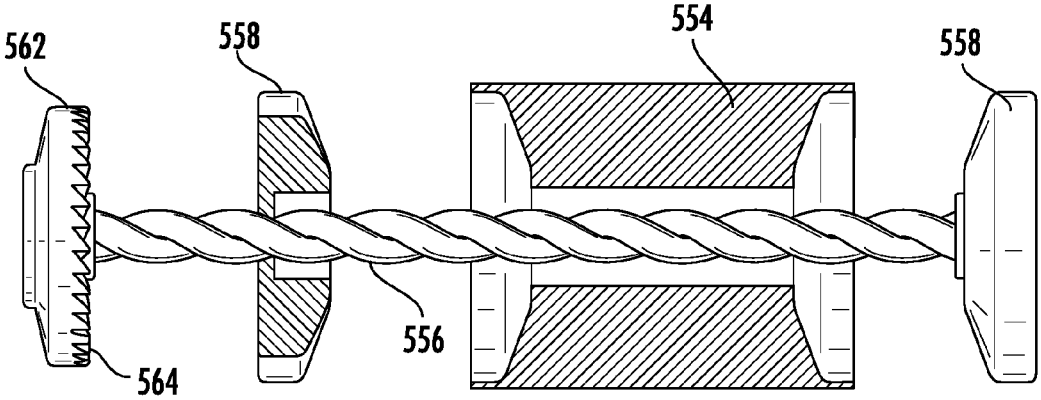
FIG. 8B is an exploded view of the interchangeable elastic component of FIG. 8A.
Figures 9A, 9B, 9C:
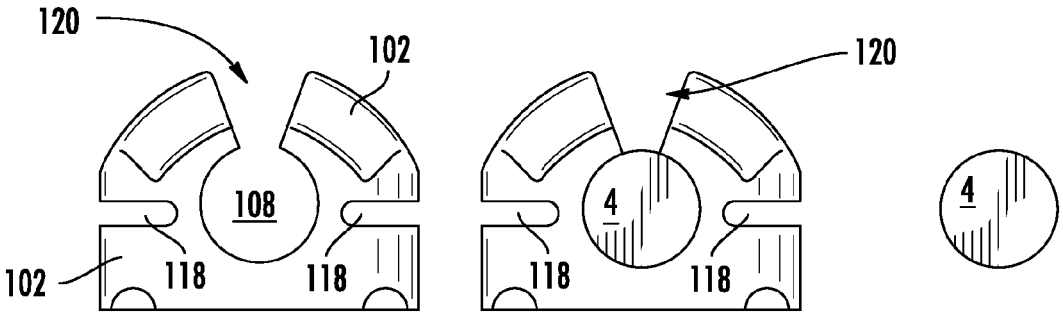
FIGS. 9A, 9B and 9C are elevations demonstrating an embodiment of the string guide member having relief slots that intersect opposite sides of the string guide member, the string guide member assembled with the interchangeable elastic component and an interchangeable elastic component.

In an alternate embodiment, a central elastic member 556, which may be a plurality of elastic bands, is connected at each end to a pressure plate 558 that may fit within a recess in the ends of an elastic component 554. FIG. 8A and FIG. 8B. The central elastic member passes through a lumen or central aperture in the elastic component, and may be rotated to tighten the bands and increase pressure on the ends of the elastic component. Teeth 564 may be formed in a cap 562 of the pressure plate on one end thereof to grip an end plate, which may be formed of an elastomeric material so that as the central elastic member is wound to tighten the central elastic member, the teeth hold the pressure plates in place. As with the embodiment in FIG. 7, applying pressure to the end of the elastic component by tightening the bands 556 increases the compression resistance of the device, while releasing pressure from the pressure plates as applied by the bands reduces the compression resistance of the interchangeable elastic components.

Reducing the surface area of contact between the interchangeable elastic component and the string guide chamber reduces friction encountered upon manual placement of the interchangeable elastic component. This "rib" or "ridge" profiles provided at the inner walls of the string guide chamber as shown in FIG. 4 are an example of a structure of this type. By reducing surface area of contact between the interchangeable elastic component and the space into which it is placed, less friction and compressive resistance to placement is encountered, and the operation may be easily accomplished by manual placement of the interchangeable elastic component into the chamber of the string guide members.

Additionally, properties of the device may be modified by varying the size of the interchangeable elastic component, using multiple interchangeable elastic components at the same time, and/or providing irregular geometries for one or both of the interchangeable elastic component and the string guide member's chamber.

Total elastic deformation bears a direct relationship to the cross-sectional area of the interchangeable elastic component. In the least complex example increasing the diameter of a circular cross-section interchangeable elastic component from 6 mm to 9 mm diameter seems to produce more than double the string elongation for a given force of impact. An embodiment that incorporates this property as a variable provides for an opportunity for a larger string guide chamber to accommodate a larger interchangeable elastic component.

The interchangeable elastic component may be constructed in a laminated manner comprising a plurality of concentrically placed elastic elements. The concentric layers may each be comprised of different materials. For example, an interchangeable elastic component having three elastic layers concentrically placed around an inner core, with the outermost of the elastic layers comprised of an effectively non-compressible material yields a device with less string elongation for a given impact force than if constructed with all three layers having equal compressibility. This configuration (with a large string guide void) increases the potential for elastic response to be scaled across a broad spectrum of impact forces and stringing tensions.

The device may comprise multiple interchangeable elastic components. More than one string guide chamber for receiving the interchangeable elastic components may be provided in the string guide member. This configuration has the capability to increase total string elongation for a given impact, in that multiple interchangeable elastic components contribute to total elastic deformation. Multiple interchangeable elastic components may afford optimal sizing for the elastic components, while meeting requirements for string elongation. Additionally, the use of multiple interchangeable elastic components can reduce height and weight of the devices, which may be of benefit in specific applications.

Interchangeable elastic components and corresponding string guide voids, cavities, or chambers may be designed with irregular geometries. These embodiments allow for optimization of total device height to meet spatial requirements of specific installations, and may be employed to reduce or increase device weight, and may be useful in controlling cross-sectional areas of the interchangeable elastic component.

Figure 11B:
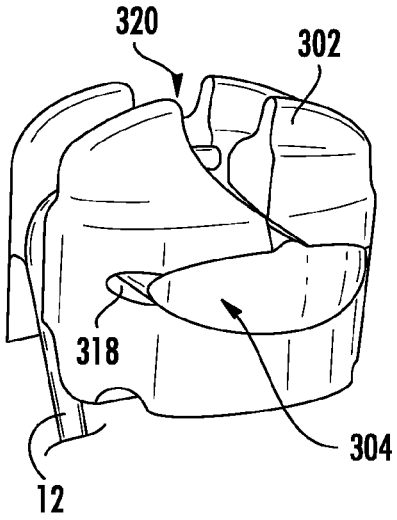
FIG. 11B demonstrates string guide member shown with an irregular geometry interchangeable elastic component in an ovoid configuration.

The interchangeable elastic components may have ovoid, elliptical and irregular (dumbbell) cross-sections. FIG. 11. Non-circular cross-sections may offer certain advantages in providing lower profile designs and larger cross-sectional areas achieved as compared to circular geometry designs.

The embodiment shown in FIG. 11A utilizes a triple dumbbell shaped interchangeable elastic component 204, essentially creating the effect of three interchangeable elastic components placed across the string guide. This embodiment provides for a relatively large cross-sectional area of the interchangeable elastic component, while providing a low profile and lower mass than would be required for a round cross-section interchangeable elastic component. Additionally, this shape may provide an opportunity to separate and distribute elastic nodes across a pathway at different portions of the string guide member. An elliptical interchangeable elastic component 304 provides a relatively large cross-sectional area and a low profile device. A structural relief slot or gap 218, 318 extends into the central void or chamber, but not to the outer walls of the string guide member.

Figure 15:
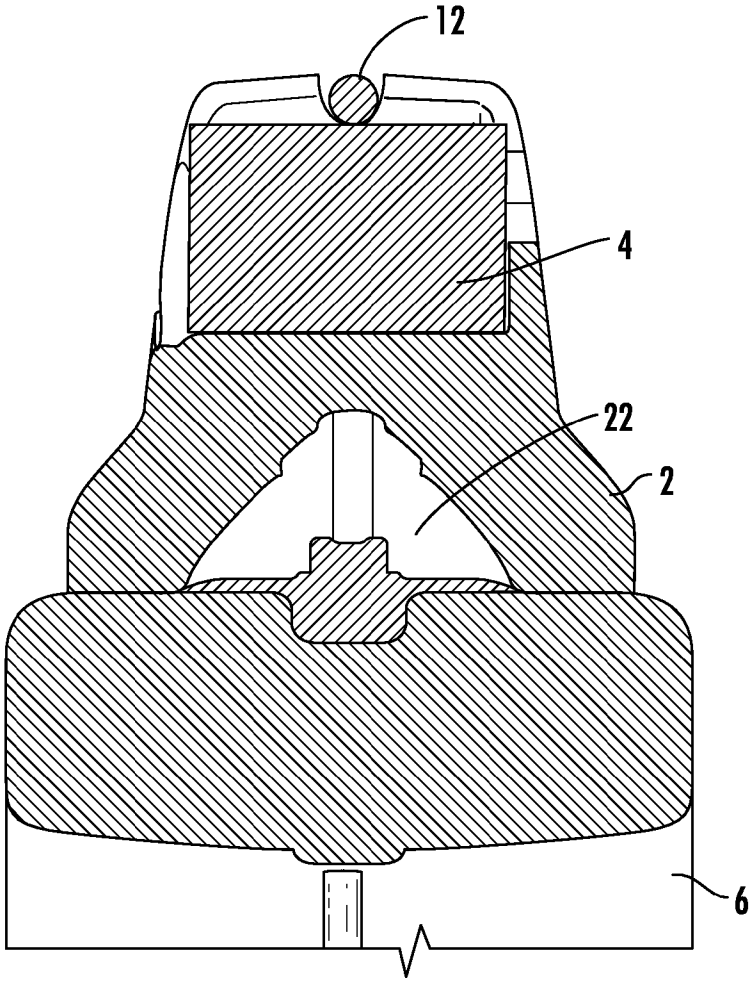
FIG. 15 is a sectioned view of the device as shown in FIG. 14.
Figure 14:
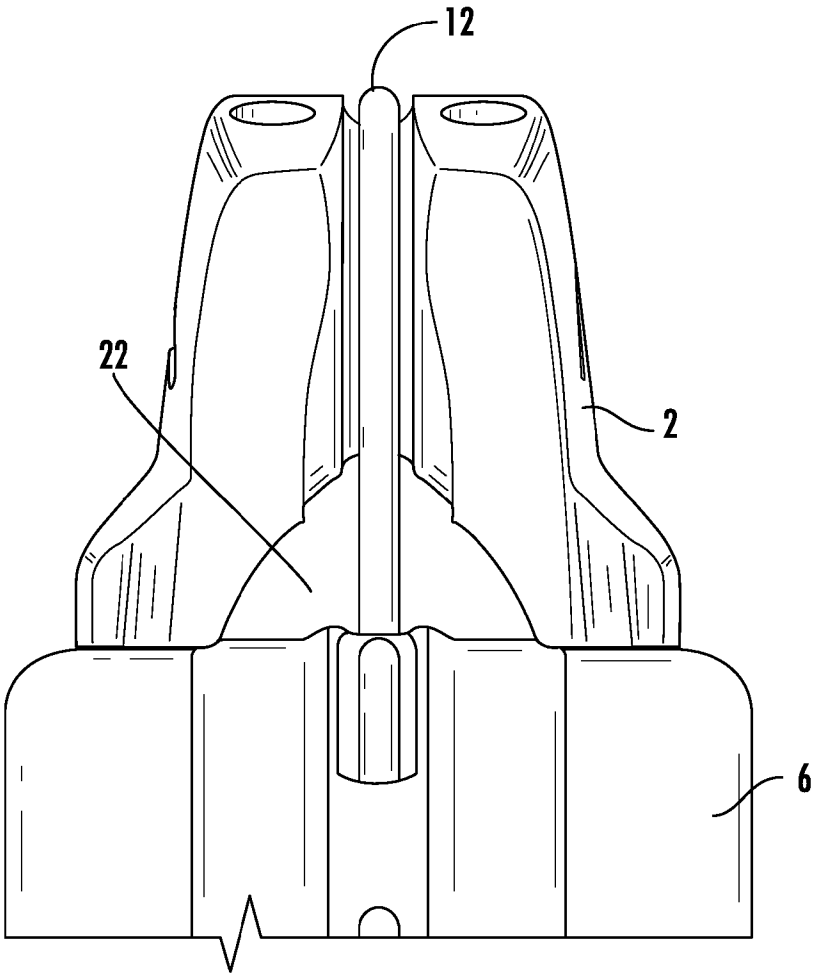
FIG. 14 is an end view an embodiment of the device of FIG. 13 mounted on racquet frame

The string guide member of the embodiment of FIG. 1 comprises a conforming groove 22 at its base that runs parallel to the edge of the racquet frame 6. FIG. 14; FIG. 15. This groove accommodates the protruding profiles of grommet and cleat inserts found on some commercially produced tennis racquet frames. Commonly, protruding grommet and cleat profiles that project above the outer surface of the racquet frame are found at the neck cross member parts of racquet frames.

Figure 12A:
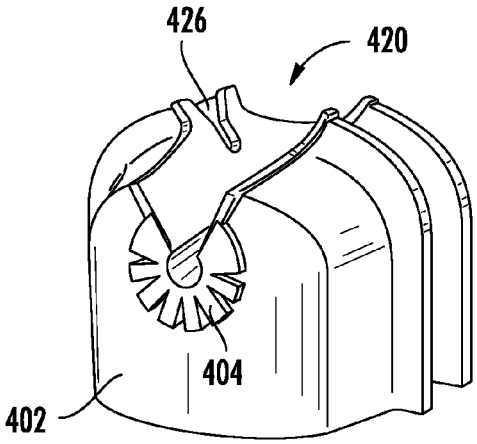
FIG. 12A is a perspective view of an embodiment of a string guide member with an interchangeable elastic component having an integrated "shim" of variable thickness for selectively controlling a width of the upper gap.
Figure 12B:
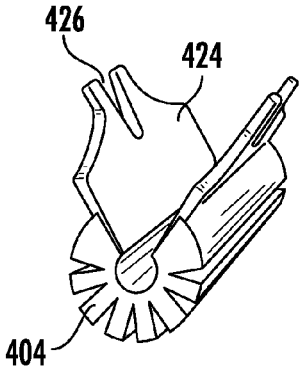
FIG. 12B is an isolation of the "shim" of variable thickness of FIG. 12A.

An interchangeable elastic component 404 is shown in FIG. 12 with integrated variable thickness shims 424 with opposing sides that extend from the interchangeable elastic component. Shims may be constructed of different thicknesses. Variation thickness allows for adjustment of string elongation potential. The shims limit the travel of the sides of the string guide member toward each other when the device is under compression. Accordingly, thicker shims result in less potential movement across the apical structural relief slot or gap as the side walls are closer together at resting tension, move a shorter distance before sidewall contact occurs. The shims may have slots 426 that permit the string of the racquet to pass through the shims. The device in this embodiment, as in the others, has an upper, apical gap, but it may or may not have lower relief gaps or slots.

A structural relief slot 420 is provided at the apex of the string guide member; or about the periphery of the string guide member with opposing surfaces having a specified distance between said opposing surfaces. At the tension that the racquet is initially strung the opposing faces of the structural relief slot are at a maximum distance apart. This distance is intrinsic to the design of the string guide member and is determined at the time of manufacture. An alternate embodiment provides shims that are inserted between the faces of the structural relief slot, allowing for adjustment of maximal string elongation at the time that the racquet is strung. Shims are placed within the gap provided by the apical structural relief slot. This component provides for a greater degree of tuning for the racquet at the time of stringing. Insertion of slims at this step in the stringing process allows the player to specify how much elongation can occur for a given string pair. This feature accommodates a need to be able to control string elongation while permitting production of string guide members having a standard slot dimension. Further the shim inserts may be comprised of elastic material permitting some degree of compression beyond the limit at which the gap faces meet when the ball strikes the racquet face. This structural arrangement allows for two steps of elastic response to force: relatively more elastic deformation (mediated by physical properties of the interchangeable elastic component) before contact of the structural relief slot faces and less elastic deformation once the faces have contacted (mediated by physical properties of the shim component).

In an embodiment, a shim is integrated into the design of the interchangeable elastic component. The interchangeable elastic component and shim controlling elongation component may be integrated into a single unit. This unit comprises a relatively elastic portion corresponding to the interchangeable elastic component previously described, and a less elastic shim portion having opposed side walls that meet when subjected to string impact force. This design provides for single unit interchangeable elastic components having the capacity to control elongation, resting tension parameters, and elastic response to impact force. The device in this embodiment has an upper, apical gap, but it may or may not have lower relief gaps or slots, as is true with the other embodiments.

Interchangeable elastic inserts are selectively positioned around the perimeter of the racquet frame according to an individual player's needs or desires. Greater string elongation occurs for those strings (string pairs) that comprise loop(s) passing over the elastic insert upon increased tensile force occurring when the ball is struck. Further, when a specified level of compression of the interchangeable elastic component is reached, the string guide member component becomes more rigid, effectively providing a two level elastic system. This mechanism permits the user to specific elongation limits for string pairs. This characteristic of the device may be determined at the time of manufacture, wherein a gap (or gaps) of specific dimension is provided at the apex, or around the perimeter of the string guide member. When subjected to adequate force, the string guide member deforms to a degree sufficient to bring the edges of the gap(s) in contact, thus creating substantial resistance to further deformation.

The device is capable of providing attenuation of impact transmitted through the racquet to the player's upper extremity. This feature may benefit players who suffer from repetitive impact injuries to the upper extremity. The attenuation of impact provided by the invention may result in lessened pain to wrist, elbow and shoulder joints. The capability to modify the physical response to impact characteristics may be used to cause less peak impact force to be transmitted through the racquet system to the player's limb. Material selection and geometric considerations influencing both the string guide member and the interchangeable elastic component(s) of the device will affect peak force over time gradients transmitted to the player's limb.

These same characteristics that may be adjusted to produce a racquet system that provides less impact to the player, and may also be specified to enhance certain physical characteristics affecting interaction between the racquet and ball. Material selections for both the string guide member and the interchangeable elastic component(s) may be chosen to provide greater or lesser degrees of elastic deformation given equivalent impact force. These characteristics may be exploited through material selection choices or design geometry to provide relatively longer or shorter dwell times in which the ball is in contact with the strings. By maximizing the period of time in which the ball maintains contact with the strings the potential to impart greater energy in the form of increased velocity or angular momentum to the ball in the form of spin is increased. Shorter dwell times imparted by those materials and geometric designs exhibiting the shortest times to shape recovery can impart greater energies per unit time to the ball resulting in a configuration having a "feel" of greater "pop" and effectively result in greater acceleration and potentially maximum speeds upon return for the ball.

The invention provides the capability to alter the structural and mechanical properties of a racquet and string combination by allowing for increased deflection and elongation of selected strings, or string pairs, given an equivalent ball impact force. A deeper "pocket" may be achieved, and increased "dwell time" is realized through increased string elongation at selected string pairs. The depth of pocket and dwell time with a ball in contact with the string bed are both related to the Starling Principle, which describes pressure/radius/wall tension relationships for curved vessels containing a pressurized fluid—force and thus potential string elongation force effectively varies with the square of the radius of curvature. As the flat "membrane" of the string bed is deformed upon impact, less and less force is required to cause greater deformation. Further as the string bed is deformed, the strings are moved further apart, creating a larger surface area, and resultant deeper pocket. The properties of the device may be selectively altered through the placement of one or more interchangeable elastic components selected from a range of available interchangeable elastic components placed at the time of racquet stringing to change playing characteristics. Alternatively, the interchangeable elastic component(s) portion of the device may be designed to provide for adjustment of elastic properties remote from the time of stringing, allowing for addition or subtraction of tension within the entire racquet and string system. The device provides an extremely wide range of playing characteristics of a racquet string combination of a single racquet to match preferences of individual players. Elastic properties of inserts may be varied across a spectrum of compressibility, viscosity, time/force response and other physical properties to optimize racquet customization options to meet varied player styles and capabilities. Furthermore, placement of the inserts may occur at virtually any position around the racquet frame, providing a further level of variability in tuning to the racquet and string system.

When the variability inherent to the device is considered in conjunction with physical characteristics of available string choices, the "tuneability" of the system is further increased. Adding the elastic characteristics of the device of the device to a rigid string type for instance will alter the perceived "feel" of said string type, and may expand the string options available to a given player. The device affords a way to play string compositions that were heretofore to "harsh" to play effectively. Beyond attenuation of perceived impact, the elastic recovery profile of a given interchangeable elastic component(s) may be exploited to produce time effects decreasing or increasing dwell times producing desirable characteristics of quick or slow release.

The device permits tuning of racquets to individual player needs and requirements. Differential play characteristics for individual string pairs on the same racquet can be achieved, which in turns alters physical characteristics of ball/string bed interactions. The device can be used with a multitude of currently available racquet and string systems. The device provides for modification of relative string motion at impact, which has known beneficial effects upon energy transfer aspects of racquet performance. The device can promote increased potential string elongation, and hence, relative string motion at the string bed upon physical deformation encountered at ball impact. The device can provide a racquet tuning system that enhances physical properties of the racquet and string system, producing a greater period of time in which the ball and strings are in contact. The device can reduce the effects of impact of a ball or other play object upon racquet strings that are harmful to the player's arm. There device that can be adjusted later through the use of the interchangeable elastic components having different properties, making the racquet and string system tunable after manufacture.

The device may be fitted to currently commercially available racquets. It may be used in conjunction with commercially available tennis, racquet ball, squash or badminton racquets. While these represent readily available and well known sports utilizing strung racquets for play, use of this device need not be restricted to these named applications.

What is claimed is:

1. An attachment for a racquet having strings, comprising: a string guide member constructed and arranged to receive a racquet string over a top of the string guide member, the string guide member having a chamber therein for receiving and holding an interchangeable elastic component, with the chamber comprising a receiving opening on a side of the string guide member for receiving the interchangeable elastic component, wherein the interchangeable elastic component slidably engages the chamber through the opening of the string guide, and the interchangeable elastic component is present within the chamber.

2. An attachment for a racquet having strings as described in claim 1, wherein the string guide member comprises a gap that intersects the chamber, and wherein a dimension of the gap narrows in response to dynamic pressure applied to the string guide member by the racquet string.

3. An attachment for a racquet having strings as described in claim 1, wherein the string guide member comprises an upper gap that intersects the chamber above the interchangeable elastic component, and wherein the upper gap narrows in response to dynamic pressure applied to the string guide member, and wherein the interchangeable elastic component prevents the upper gap from closing when the string guide member is under static load from the racquet string.

4. An attachment for a racquet having strings as described in claim 1, wherein the string guide member comprises a first gap that intersects the chamber, and a second gap that intersects the chamber opposite the first gap, and wherein a dimension of the first gap and a dimension of the second gap change in response to dynamic pressure applied to the string guide member by the racquet string.

5. An attachment for a racquet having strings as described in claim 1, wherein the string guide member comprises a first gap that intersects the chamber, and an upper gap that intersects the chamber above the interchangeable elastic component, and the upper gap narrows in response to dynamic pressure applied to the string guide member by the racquet string, and wherein a dimension of the first gap changes in response to dynamic pressure applied to the string guide member by the racquet string.

6. An attachment for a racquet having strings as described in claim 1, wherein the string guide member comprises a first gap that intersects the chamber, and a second gap that intersects the chamber opposite the first gap, and an upper gap that intersects the chamber above the interchangeable elastic component, wherein the upper gap narrows in response to dynamic pressure applied to the string guide member by the racquet string, and wherein a dimension of the first gap and a dimension of the second gap change in response to dynamic pressure applied to the string guide member by the racquet string.

7. An attachment for a racquet having strings as described in claim 1, wherein the string guide member comprises a first gap that intersects the chamber, and a second gap that intersects the chamber opposite the first gap, and wherein a dimension of the first gap and a dimension of the second gap each narrow in response to dynamic pressure applied to the string guide member by the racquet string.

8. An attachment for a racquet having strings as described in claim 1, wherein the string guide member comprises a first gap that intersects the chamber, and an upper gap that intersects the chamber above the interchangeable elastic component, and the upper gap narrows in response to dynamic pressure applied to the string guide member by the racquet string, and wherein a dimension of the first gap narrows in response to dynamic pressure applied to the string guide member by the racquet string.

9. An attachment for a racquet having strings as described in claim 1, wherein the string guide member comprises a first gap that intersects the chamber, and a second gap that intersects the chamber opposite the first gap, and an upper gap that intersects the chamber above the interchangeable elastic component, wherein the upper gap narrows in response to dynamic pressure applied to the string guide member by the racquet string, and wherein a dimension of the first gap and a dimension of the second gap narrow in response to dynamic pressure applied to the string guide member by the racquet string.

10. An attachment for a racquet having strings as described in claim 1, wherein the string guide member comprises a first gap that intersects a side of the string guide member, and a second gap that intersects an opposite side of the string guide member, and wherein a dimension of the first gap and a dimension of the second gap each widen in response to dynamic pressure applied to the string guide member by the racquet string.

11. An attachment for a racquet having strings as described in claim 1, wherein the string guide member comprises a first gap that intersects a side of the string guide member, and an upper gap that intersects the chamber above the interchangeable elastic component, and the upper gap narrows in response to dynamic pressure applied to the string guide member by the racquet string, and wherein a dimension of the first gap widens in response to dynamic pressure applied to the string guide member by the racquet string.

12. An attachment for a racquet having strings as described in claim 1, wherein the string guide member comprises a first gap that intersects the chamber, and a second gap that intersects the chamber opposite the first gap, and an upper gap that intersects the chamber above the interchangeable elastic component, wherein the upper gap narrows in response to dynamic pressure applied to the string guide member by the racquet string, and wherein a dimension of the first gap and a dimension of the second gap narrow in response to dynamic pressure applied to the string guide member by the racquet string.

13. An attachment for a racquet having strings as described in claim 1, wherein the chamber comprises a stop that abuts an end of the interchangeable elastic component and wherein the stop is positioned in the cavity opposite the receiving opening.

14. An attachment for a racquet having strings as described in claim 1, wherein the chamber comprises a frusto-conical void that tapers from a relatively larger cross section at the opening of the chamber to a relative smaller cross sectional dimension along the length of the frusto-conical void.

15. An attachment for a racquet having strings as described in claim 1, wherein the chamber is constructed and arranged to provide discontinuous contact with the interchangeable elastic component that is positioned in the chamber.

16. An attachment for a racquet having strings as described in claim 1, wherein the interior of the chamber comprises a plurality of ribs that provide discontinuous contact with the interchangeable elastic component that is positioned in the chamber.

* * * * *